US006280182B1

(12) United States Patent
Takahashi

(10) Patent No.: US 6,280,182 B1
(45) Date of Patent: Aug. 28, 2001

(54) DISPOSAL OF GAS EVAPORATED WITH HEAT TREATMENT

(75) Inventor: Susumu Takahashi, Yokohama (JP)

(73) Assignee: Kanto Yakin Kogyo K.K. (JP)

( * ) Notice: Subject to any disclaimer, the term of this patent is extended or adjusted under 35 U.S.C. 154(b) by 0 days.

(21) Appl. No.: 09/580,161

(22) Filed: May 30, 2000

(51) Int. Cl.[7] ..... F27B 11/00

(52) U.S. Cl. ..... 432/206; 432/2; 432/147; 110/203

(58) Field of Search ..... 432/2, 31, 65, 432/147, 175, 206; 110/203, 208

(56) References Cited

U.S. PATENT DOCUMENTS

Re. 36,960 * 11/2000 Boswell et al. ..... 432/152
2,860,864 * 11/1958 Knight ..... 432/206
3,582,054 * 6/1971 Beck ..... 432/50
4,568,279 * 2/1986 Logue et al. ..... 432/206

* cited by examiner

*Primary Examiner*—Gregory Wilson
(74) *Attorney, Agent, or Firm*—Shlesinger, Fitzsimmons & Shlesinger

(57) ABSTRACT

Organic gases and the like containing poisonous dioxin and so on which are evaporated from articles when they are subjected to a heat treatment such as degreasing, are led from a muffle where they are heated into radiant heating tubes located outside the muffle and loaded with a negative pressure, and they are discharged into the air on account of the negative pressure working in the heating tubes after they have been substantially completely pyrolyzed in the heating tubes.

4 Claims, 1 Drawing Sheet

DISPOSAL OF GAS EVAPORATED WITH HEAT TREATMENT

BACKGROUND OF THE INVENTION

When articles are subjected to heat treatment in a furnace, or heated in the furnace for degreasing, organic substances are evaporated from them into the furnace. These substances include oily gases and poisonous gases containing dioxin. Such gases which pollute the air and environment, have to be reduced before they are exhausted.

Accordingly, this invention relates to a method for reducing pollutional substances from gases evaporated from articles heated in a furnace, and it relates also to a furnace which can advantageously perform such method.

It is widely known that before gases which have been evaporated into a furnace from articles heated in the furnace, are exhausted into the air, they are led by a pipe into a combustion column which is located outside the furnace, and from which they are released into the air after they have been burnt there. However, it is difficult to lead the gases entirely into the combustion column or burners and to completely burn them, because they are not evaporated evenly at an equal amount throughout the length of the furnace in which they are heated, and additionally because the gases which are generally oily, are sticky. Such sticky gases tend to adhere to the inside of pipes and to furnace walls, becoming soft or molten. They change finally into a heap of ashes which disturb combustion and erode the furnace walls.

In this view, it is an object of this invention to provide a method, in which gases evaporated from articles heated in a furnace are smoothly led into burners located inside the furnace, whereby the gases do not stay long in the furnace and consequently do not erode the furnace walls. And, it is another object of this invention to provide a heating furnace which can advantageously perform the method.

SUMMARY OF THE INVENTION

In this invention, there is provided within a refractory furnace a thermal resistant muffle, in which articles are heated by radiant heating tubes which are located outside the muffle and in which a negative pressure works, whereby the furnace will scarcely be eroded. By adjusting opening degrees of a plurality of openings provided to circumferential walls of the muffle, a flow of gases from the muffle toward the heating tubes may freely be controlled.

THE DRAWINGS

DETAILED DESCRIPTION OF THE PREFERRED EMBODIMENTS

EXAMPLE 1

Figure 1:
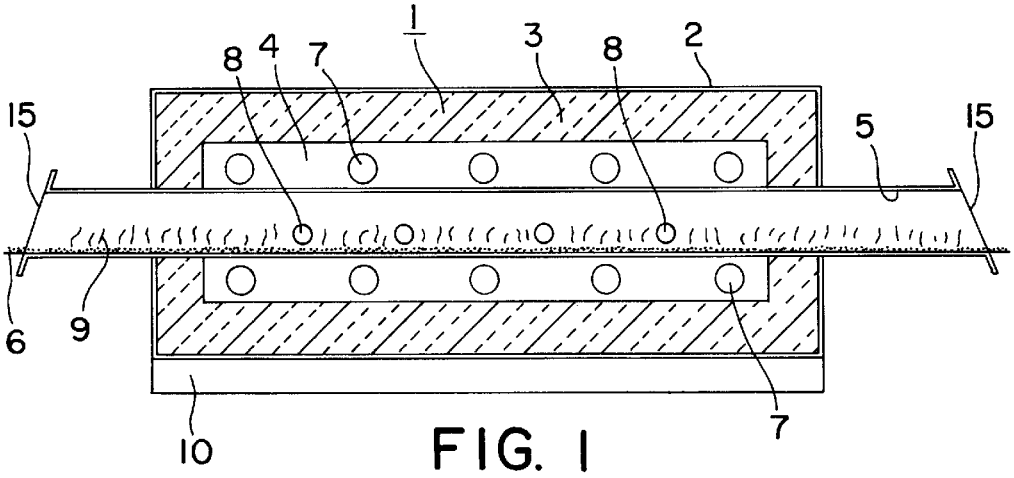
FIG. 1 is an explanatory front sectional view of a continuous heating furnace which can advantageously be employed for performing the method of this invention.
Figure 2:
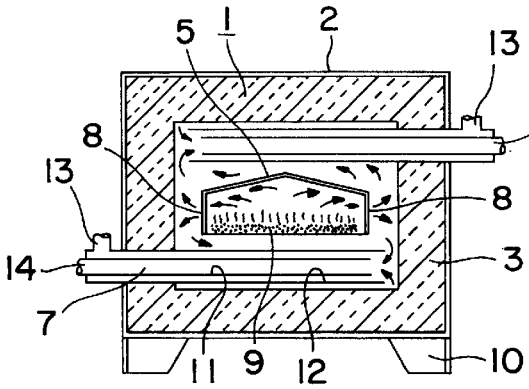
FIG. 2 is an explanatory side sectional view of the furnace illustrated in FIG. 1.

Numeral 1 represents generally an elongated heating furnace which was employed for performing the method of this invention. A steel outer shell 2 of the furnace 1 covers refractory materials 3, while an elongated furnace chamber 4 having a rectangular cross-section are enclosed by the refractory materials 3. In this example, the furnace chamber is 100 cm in width, 70 cm in height, and 296 cm in length.

Throughout the entire length of the furnace chamber 4, there is extended a thermal resistant steel muffle 5 with its both ends projecting outside the chamber. The muffle 5 is hermetically sealed against the furnace chamber, except a plurality of openings 8. In this example, this muffle is 80 cm in width, 30 cm in height, and 296 cm in length.

The above-mentioned openings 8 are provided in circumferential walls of the muffle, More particularly, in this example, on each sides of the muffle, four circular openings of 6 cm in diameter are provided, while if desired, they may be in upper or bottom walls of the muffle. Opening degrees of them can be adjusted from the outside of the furnace, although adjusting mechanisms are not shown in order to make the drawings simple.

The both free ends of the muffle 5 are removably covered by shutters 15. A conveyor belt 6 circulates through the muffle, and articles to be heated pass through the muffle, being carried by the conveyor belt.

Numeral 7 indicates a plurality of radiant heating tubes which are located outside the muffle and within the furnace chamber and in which a negative pressure works. Each of radiant heating tubes is consisted of an inner column 11 and outer column 12. Into the inner columns 11, there is supplied from their outwardly projecting ends 14 fuel and air, while in exhaust ends 13 of the outer columns 12 which projects outside of the furnace, a negative pressure works so as to make said ends 13 exhaust openings under a negative pressure. Opposite ends of the inner and outer columns 11 and 12 are kept open within the furnace chamber. Numeral 10 represents bases of the furnace.

The heating furnace 1 with the structures described above operates as follows.

The fuel and air supplied from the ends 14 of inner columns 11 of radiant heating tubes 7 are burnt there, and combustion waste gas is discharged into the air from the exhaust ends 13 via outer columns 12, on account of the negative pressure working in the exhaust ends 13.

Figure 3:
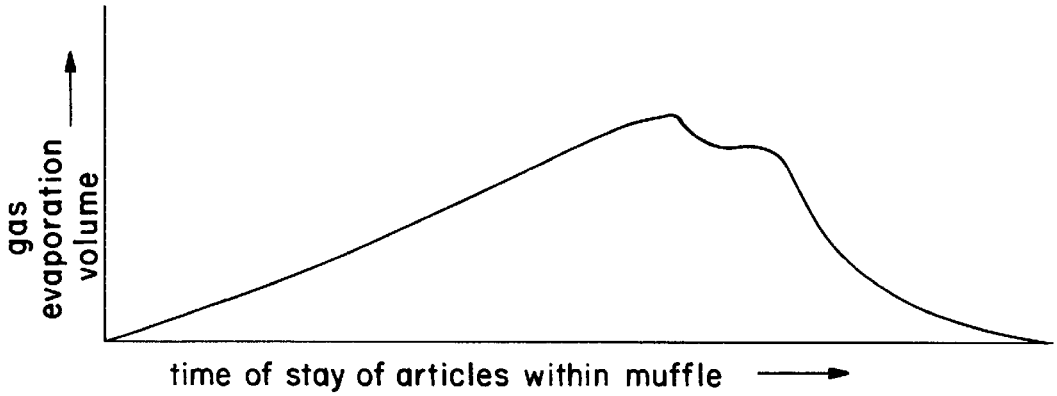
FIG. 3 is a graph explanatorily showing that when articles are advanced and heated in the furnace, an amount of gases evaporated from them increases with their advance in the furnace and with the raise of their temperature.

Articles to be heat-treated 9 are mounted on the conveyor belt, and enter into the muffle 6 from the left-hand entrance opening in FIG. 1. When the articles advance in the muffle, they are heated gradually and gases evaporated from them increase also gradually, as shown in FIG. 3. In order to let the gases flow smoothly from the muffle into the furnace chamber through the openings 8, and into the radiant heating tubes 7, opening degrees of the openings 8 may be adjusted. For example, the leftmost openings 8 in FIG. 1 are kept open by half, the next ones are open by their three quarters, and remnants are fully open.

120 Kg of steel screws of 8 g each were heated to 600° C. in the above-mentioned furnace per an hour. 1.2 Kg of machine processing mineral oil was evaporated from the screws per an hour. Evaporated oil flowed smoothly from the muffle 5 through its side openings 8, and was sucked into the heating tubes 7 where the oil was burnt together with the fuel sent to the heating tubes. The total combustion amount of natural fuel gas sent to the heating tubes 7 in this operation was 95,000 Kcal/hour, and air was sent to the heating tubes so that a residual amount of oxygen in an exhaust gas from the exhaust ends 13 could be kept at about 5% of the exhaust gas. Because of that no methane was detected in the exhaust gas from the exhaust ends 13, it was confirmed that the mineral oil evaporated from the screws had been completely pyrolyzed.

After the operation for 150 hours in total, the muffle empty of screws was heated to 700° C. for two hours, whereby evaporation from the muffle was observed, showing that oily heaps adhered to muffle walls were subjected to a high temperature, evaporated, and removed.

EXAMPLE 2

Nitrogen gas was sent into the muffle 5 described in Example 1 so that air should not enter into the muffle from its entrance and exit openings, and the furnace was heated to 600° C., in which an impregnated carbon fiber fabric of 43 Kg was treated per an hour. No methane was detected in exhaust gases from the furnace.

EXAMPLE 3

Into the above-mentioned muffle, there was supplied nitrogen gas so that air should not enter into the muffle from its entrance and exit openings. When 400 pieces (200 Kg in total) of green molds for gears made from structural chrome steel powders were sintered per an hour by heating them to 600° C., more than 98% of high polymers impregnated in the green molds as binders were removed by evaporation. No methane was detected in the exhaust gases from the furnace.

As apparent from the above detailed explanation of this invention, organic substances and the like which were contained in articles and which were evaporated from the articles when they were heated in a furnace, were exhausted from the furnace only after they had been almost completely pyrolyzed. It is economic too that the organic substances and the like evaporated from the articles are burnt in the furnace, as an additional heating source for the furnace.

What is claimed is:

1. A method for treating gases evaporated from articles heated in a furnace, which comprises heating articles within a thermal resistant muffle located in a furnace chamber enclosed by refractory materials by means of radiant heating tubes which are located within the furnace chamber but outside the muffle, leading gases evaporated from the articles into the heating tubes through a plurality of openings provided to circumferential walls of the muffle and by a negative pressure working in the heating tubes, and discharging the gases to the air from the heating tubes after they have been burnt and pyrolyzed in the heating tubes.

2. The method as claimed in claim 1, in which degrees of opening of the openings of the muffle are adjustable.

3. The method as claimed in claims 1 or 2, in which the muffle empty of the articles to be heated is heated to a temperature higher than a normal operational temperature for heating heaps of residual articles within the furnace chamber and muffle and removing them from the furnace by evaporating them.

4. A heating furnace for treating gases evaporated from articles heated in the furnace, which comprises a furnace chamber enclosed by refractory materials, a thermal resistant muffle located within the furnace chamber and having at its circumferential walls a plurality of openings, radiant heating tubes located within the furnace chamber but outside the muffle for heating the articles via the muffle and for sucking gases evaporated from the articles into the tubes by means of a negative pressure working in the heating tubes, and discharge openings connected to the heating tubes for exhausting the gases after they have been pyrolyzed in the heating tubes, the degrees of opening of the openings provided to the muffle are made adjustable.

* * * * *